US006105784A

United States Patent [19]

Salminen et al.

[11] Patent Number: 6,105,784

[45] Date of Patent: Aug. 22, 2000

[54] PACKAGING

[75] Inventors: Tiina-Maria Salminen, Halikko; Hanna Sonne, Rauma; Pentti Juhani Laiho; Ulla Uimonen, both of Salo, all of Finland

[73] Assignee: Nokia Mobile Phones, Ltd., Espoo, Finland

[21] Appl. No.: 09/243,703

[22] Filed: Feb. 2, 1999

[30] Foreign Application Priority Data

Feb. 10, 1998 [FI] Finland ..... 980303

[51] Int. Cl.[7] ..... B65D 25/54

[52] U.S. Cl. ..... 206/775; 206/1.5

[58] Field of Search ..... 206/775, 776, 206/777, 1.5, 468, 758, 525; 220/23.87

[56] References Cited

U.S. PATENT DOCUMENTS

| | | | |
|---|---|---|---|
| 3,837,475 | 9/1974 | Bolanz | 206/776 |
| 3,946,870 | 3/1976 | Gajer et al. | 206/775 |
| 4,284,204 | 8/1981 | Carey, Jr. | 206/1.5 |
| 4,561,544 | 12/1985 | Reeve . | |
| 5,170,494 | 12/1992 | Levanto . | |
| 5,189,632 | 2/1993 | Paajanen et al. . | |
| 5,214,309 | 5/1993 | Saarnimo . | |
| 5,229,701 | 7/1993 | Leman et al. . | |
| 5,253,146 | 10/1993 | Halttunen et al. . | |
| 5,263,577 | 11/1993 | Paratte et al. . | |
| 5,265,158 | 11/1993 | Tattari . | |
| 5,271,056 | 12/1993 | Pesola et al. . | |
| 5,275,291 | 1/1994 | Sledge | 206/1.5 |
| 5,285,897 | 2/1994 | Oaki | 206/1.5 |
| 5,361,459 | 11/1994 | Hyvonen et al. . | |
| 5,603,103 | 2/1997 | Halttunen et al. . | |
| 5,642,402 | 6/1997 | Vilmi et al. . | |
| 5,669,069 | 9/1997 | Rautila . | |
| 5,768,370 | 6/1998 | Maatta et al. . | |
| 5,779,115 | 7/1998 | Parkas et al. . | |
| 5,787,341 | 7/1998 | Parkas et al. . | |
| 5,809,115 | 9/1998 | Inkinen . | |

FOREIGN PATENT DOCUMENTS

| | | |
|---|---|---|
| 2 042 476 | 9/1980 | United Kingdom . |

OTHER PUBLICATIONS

Finnish Office Action.

*Primary Examiner*—Paul T. Sewell
*Assistant Examiner*—Luan K. Bui
*Attorney, Agent, or Firm*—Perman & Green, LLP

[57] ABSTRACT

Packaging for an article having an insert (11) has a central projecting portion to accommodate an article. A catch (14) projects from a rim of the insert (11) and is wedge shaped to guide the insert (11) into a box (3) designed to contain the insert. During the insertion process, the catch (14) slides against an inner surface of the box (3) until it reaches an aperture (8) in the box wall. The catch (14) then engages the aperture (8) to resist removal of the insert (11), until the catch (14) is pressed and released by a user.

5 Claims, 2 Drawing Sheets

PACKAGING

FIELD OF THE INVENTION

The present invention relates to packaging for articles.

BACKGROUND OF THE INVENTION

A common form of packaging for an article is known as "bubble" packaging. An elongate sheet of rigid plastics material is moulded to conform generally to the shape of the article to be packaged. The plastics sheet can then be folded about the article to sandwich the article between its two halves.

For industrial purposes, it is desirable to decrease the amount of different steps in the packing process to a minimum in order to reduce costs and maximise packing speed. Furthermore, it is desirable to minimise packaging volume and to enable packaging to be reusable by the end-user.

Bubble packaging requires accurate alignment of the article to be packaged and of the two halves of the plastics sheet during the packing process. This is a relatively time consuming operation. The assembled packaging may also have a non-uniform shape which makes the bundling together of several packagings difficult. Bubble packaging uses a relatively large amount of plastics material and may therefor be uneconomic and wasteful.

SUMMARY OF THE INVENTION

It is an object of the present invention to provide for the speedier packaging of articles and to facilitate easier packaging.

According to the present invention there is provided packaging for an article or set of articles, the packaging comprising:

an insert shaped to accommodate an article or articles to be packaged;

a box arranged to contain the insert;

a catch member projecting from a surface of the insert;

an aperture provided in a wall of the box;

wherein, when the insert is contained within the box, the catch is arranged to project through said aperture to resist removal of the insert from the box, and wherein the insert can be released by the action of pressing the catch through the aperture from the outside of the box.

It will be appreciated that the action of pushing the insert into the box to engage the catch in the aperture locks the packaging and, to open the packaging, the user only needs to press the catch through the aperture in the wall of the box to release the insert and the packaged article(s), without damaging the packaging.

Preferably, said box is made of semi-rigid material, e.g. cardboard.

Alternatively, said box is made of plastics material.

Preferably, the insert is of a transparent plastics material and the box is provided with a window therein, such that the contents of the packaging are visible through the aperture in the box and the transparent insert.

As embodiments of the invention may be made from two easily separable parts, i.e. the box and the insert, recycling of these parts is easily achieved.

Preferably, the catch is wedge shaped to prevent the catch from snagging against the edge of the box, which edge defines the opening through which the insert is pushed.

Preferably, the catch projects from the insert sufficiently to engage an inner surface of the box during insertion of the insert. This results in the catch being strained so that, when the catch arrives at the aperture, this strain is released giving rise to a 'click' sound.

Preferably, the packaging comprises a shoulder at an end region of the insert opposite to an end region at which said catch is provided, the shoulder being arranged to abut an edge of the box when the insert is fully inserted into the box.

BRIEF DESCRIPTION OF THE DRAWINGS

For better understanding of the present invention and in order to show how the same may be carried into effect reference will now be made, by way of example, to the accompanying drawings in which.

DETAILED DESCRIPTION

Figure 1:
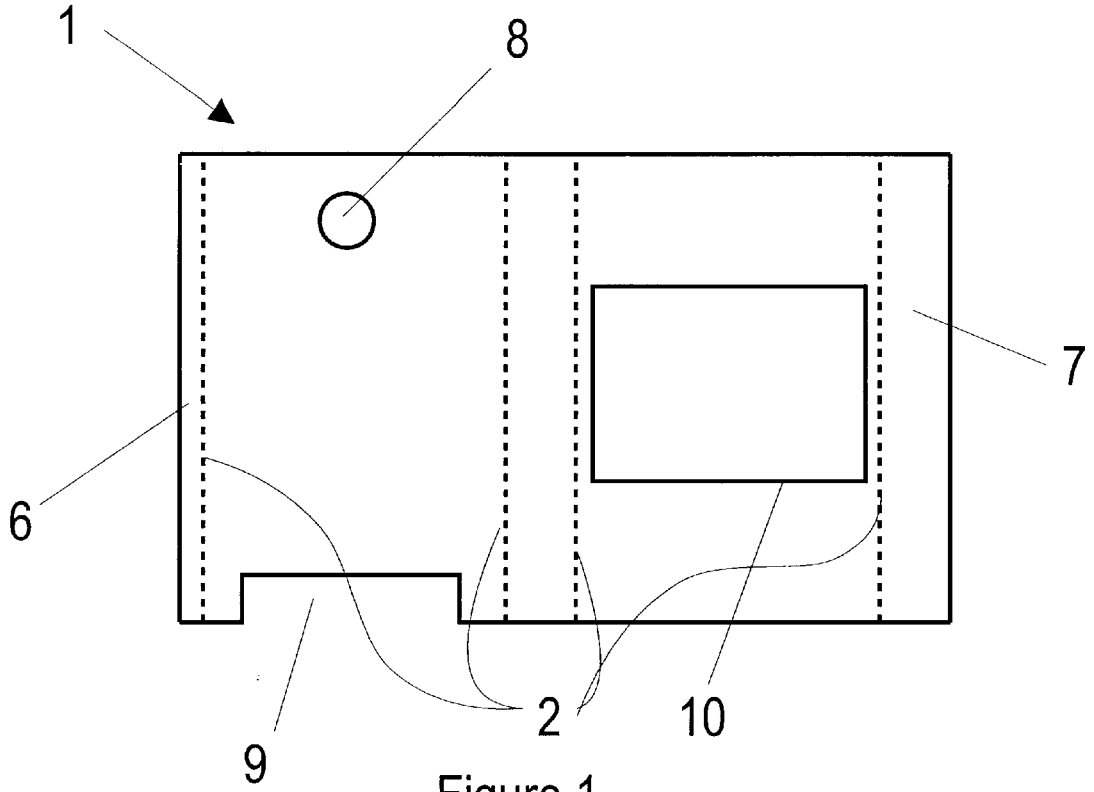
FIG. 1 shows a cardboard sheet for forming a packaging box.
Figure 2:
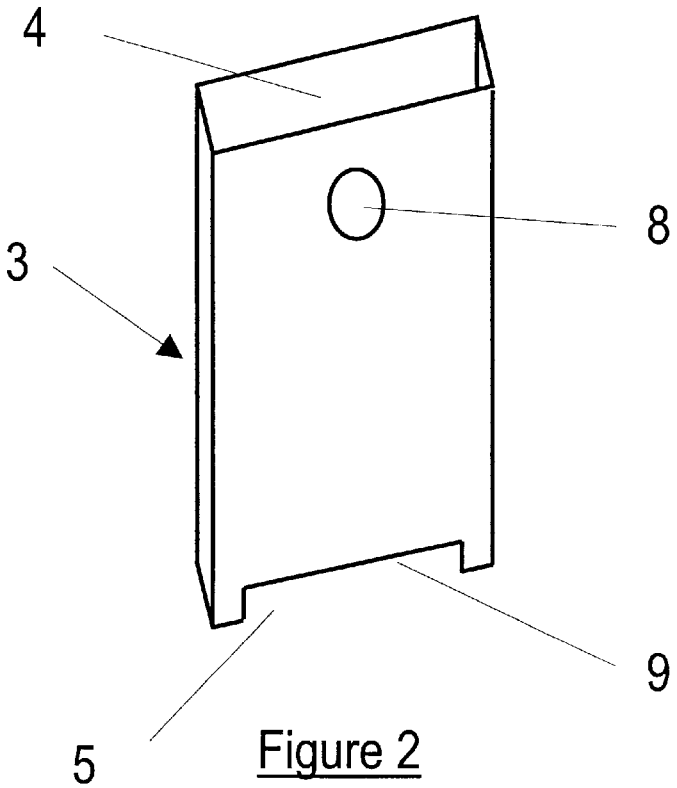
FIG. 2 shows a perspective rear view of a box formed from the sheet of FIG. 1.

A rectangular sheet of cardboard 1 is shown in FIG. 1 and which can be folded along the dashed lines 2 to form a box 3 having top and bottom openings 4 and 5 as shown in FIG. 2. When folded, two overlapping edges 6 and 7 of the sheet 1 are joined together with adhesive. The sheet 1 has three apertures therein which in the finished box 3 provide a circular aperture 8 near the top of the rear box wall, a rectangular notch 9 extending from the bottom edge of the rear box wall, and a rectangular window 10 in the centre of the front box wall.

Figure 3A:
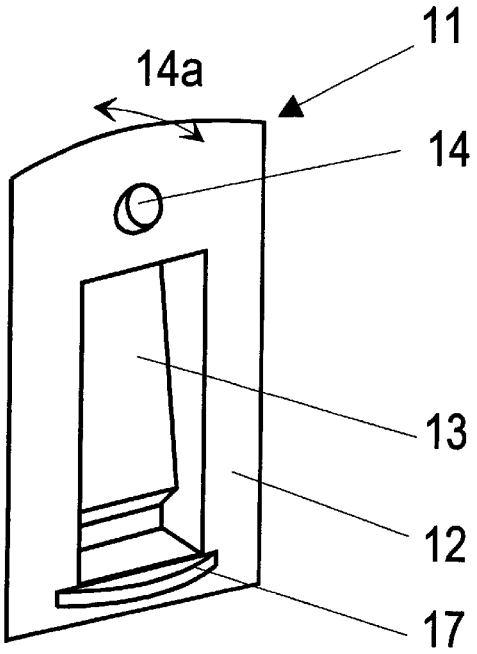
FIG. 3*a* shows a perspective rear view of a packaging insert.
Figure 3B:
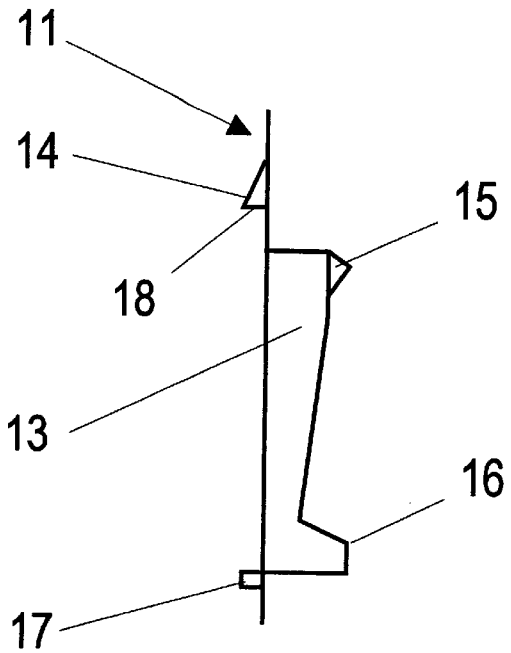
FIG. 3*b* shows a side view of the insert of FIG. 3*a;*

FIGS. 3*a* and 3*b* show an insert 11 moulded from a flat rectangular sheet of transparent plastics material such that the insert 11 has a flat peripherally extending rim 12 and a central projecting portion 13 shaped to accommodate an article to be packaged. Moulded projections of the sheet provide a catch 14 and pair of ridges 15 and 16. The insert 11 is additionally provided with a shoulder 17 on the lower rim portion, which projects in a direction opposite to that of the central projecting portion 13.

The catch 14 is provided in that part of the rim 12 which extends above the central projecting portion 13, when the insert 11 is viewed as shown in FIGS. 3*a* and 3*b*. The catch 14 projects in a direction opposite to that in which the central projecting portion 13 projects. The placement of the catch 14 on the rim provides the catch 14 with a spring-like property, i.e. the catch 14 and adjacent rim portion are able to flex relative to the rest of the insert 11. This is illustrated in FIG. 3*a* by the arrow 14*a*. The catch 14 is wedge shaped to guide the insert 11 through the bottom opening 5 of the box 3. Moreover, the lower perpendicular edge 18 of the catch 14 provides a locking edge which acts against the lower surface of the aperture 8 of the box 3, when the insert 11 has been fully inserted into the box 3 so that the catch 14 pops through the aperture 8.

The function of the shoulder 17 of the insert 11 is to engage the upper edge of the notch 9 to define the full limit of insertion of the insert 11 into the box 3, i.e. at a position where the catch 14 engages the aperture 8. The pair of ridges 15 and 16 project from the central projecting portion 13 to a similar extent to engage the opposed wall of the box 3. The ridges 15 and 16 provide a friction fit for the insert 11 to resist movement of the insert 11 within the box 3. This reduces the risk of the insert 11 accidentally dropping out of the box 3 during insertion and also inhibits rattling when the insert 11 has been inserted.

Figure 4:
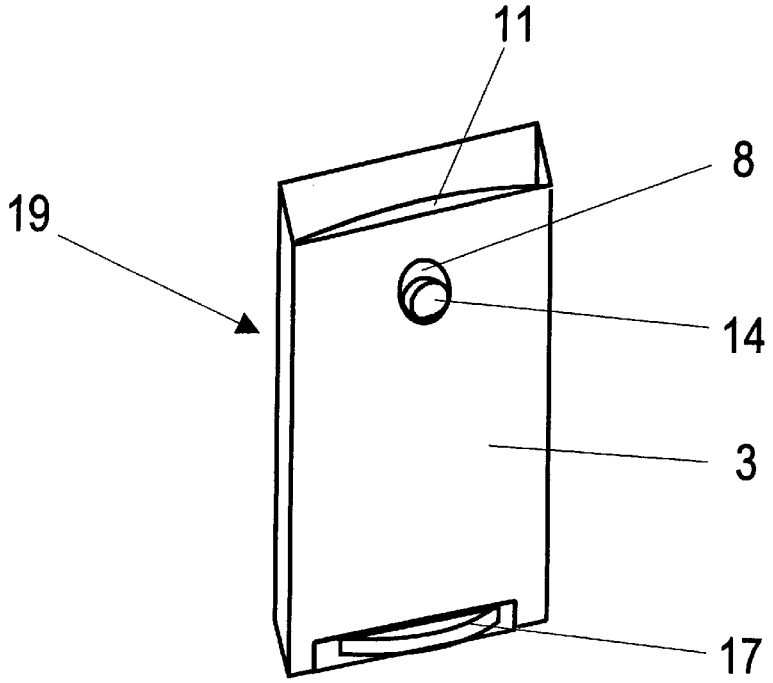
FIG. 4 shows a perspective rear view of packaging assembled from the box of FIG. 2 and the insert of FIG. 3*a*.

FIG. 4 shows the packaging assembled from the box 3 and the insert 11. As will be apparent, in order to release the insert 11 from the box 3, a user presses the catch 14 with a finger to push the catch 14 through the aperture 8 of the box 3. The insert 11 can then be pulled (or pushed) out of the box 3, through the bottom opening 5, by grasping the shoulder 17.

The window 10 in the wall of the box 3 allows the article(s) in the assembled packaging 19 to be viewed through the window 10 and the plastics insert 11.

It will be appreciated by the skilled person that modification may be made to the above described embodiment without departing from the scope of the present invention. For example, the aperture 8 may be replaced with a notch extending downwards from the upper edge of the box 3, which in that case it is sufficient to press the rim portion above the catch 14 in order to release the catch 14. In other modifications, the catch 14 may be located another surface of the insert, for example on side portions of the rim or on the central projecting portion.

What is claimed:

1. Packaging for an article or set of articles, the packaging comprising:

an insert of transparent plastic material shaped to accommodate an article or articles to be packaged;

a cardboard box arranged to contain the insert, the cardboard box including opposed spaced apart front and rear box walls, a window provided in the front box wall such that the article or articles in the insert are visible through the window in the box and the transparent insert;

a catch member projecting from a surface of the insert; and an aperture provided in the rear box wall;

wherein the catch is arranged to project through the aperture in the rear box wall to resist removal of the insert from the box, and wherein the insert can be released by the action of pressing the catch through the aperture from the outside of the box.

2. Packaging according to claim 1, wherein the box has an edge defining an opening through which the insert is pushed; and wherein the catch is wedge shaped to prevent the catch from snagging against on the edge of the box.

3. Packaging according to claim 1, wherein the catch member projects from the insert sufficiently to engage an inner surface of the box during insertion of the insert, the catch member being strained so that, when the catch member arrives at the aperture, this strain is released as the catch member returns to its original position thereby causing a noticeable sound.

4. Packaging according to claim 1, the insert comprising a shoulder at an end region of the insert opposite to an end region at which said catch is provided, the shoulder being arranged to abut an edge of the box when the insert is fully inserted into the box.

5. Packaging according to claim 1, wherein the insert is shaped to conform to the article or articles therein.

* * * * *